US012103733B2

(12) United States Patent
Spadavecchia

(10) Patent No.: US 12,103,733 B2
(45) Date of Patent: Oct. 1, 2024

(54) TWO-PIECE VIBRATION DAMPENING PALLET ASSEMBLY

(71) Applicant: Polymer Solutions International Inc., Medford, NJ (US)

(72) Inventor: John A. Spadavecchia, Red House, VA (US)

(73) Assignee: Polymer Solutions International, Inc., Medford, NJ (US)

( * ) Notice: Subject to any disclaimer, the term of this patent is extended or adjusted under 35 U.S.C. 154(b) by 907 days.

(21) Appl. No.: 17/084,077

(22) Filed: Oct. 29, 2020

(65) Prior Publication Data

US 2021/0122523 A1 Apr. 29, 2021

Related U.S. Application Data

(60) Provisional application No. 62/927,565, filed on Oct. 29, 2019.

(51) Int. Cl.

| | |
|---|---|
| ***B65D 19/00*** | (2006.01) |
| ***B65B 13/02*** | (2006.01) |
| ***B65D 19/38*** | (2006.01) |

(52) U.S. Cl.

CPC ..... *B65D 19/0097* (2013.01); *B65B 13/02* (2013.01); *B65D 19/38* (2013.01); *B65D 2519/00273* (2013.01); *B65D 2519/00293* (2013.01); *B65D 2519/00323* (2013.01); *B65D 2519/00338* (2013.01); *B65D 2519/0098* (2013.01)

(58) Field of Classification Search

CPC ..... B65D 19/0097; B65D 19/38; B65D 2519/00273; B65D 2519/0098

USPC ..... 206/386, 805, 597, 503, 509; 108/54.1, 108/55.1, 137, 57.18, 91, 102, 149

See application file for complete search history.

(56) References Cited

U.S. PATENT DOCUMENTS

| | | | | |
|---|---|---|---|---|
| 5,845,768 | A * | 12/1998 | Simpson | B65D 71/02 108/55.3 |
| 6,494,336 | B1 * | 12/2002 | Bylo | B65D 25/2897 220/23.6 |
| 2011/0005433 | A1 * | 1/2011 | Pichereau | B65D 19/0016 248/346.02 |
| 2014/0197168 | A1 * | 7/2014 | Miller | B65D 21/0215 220/4.33 |
| 2015/0336709 | A1 * | 11/2015 | Hsiao | B65D 19/0026 206/386 |
| 2018/0127147 | A1 * | 5/2018 | Embleton | B65D 19/42 |

* cited by examiner

*Primary Examiner* — Rafael A Ortiz
(74) *Attorney, Agent, or Firm* — Buchanan Ingersoll & Rooney PC

(57) ABSTRACT

A pallet assembly for transporting a transportable unit. The pallet assembly includes a first pallet member including a support surface with at least one wall extending upwardly therefrom and a second pallet member including a support surface with at least one wall extending therefrom. A band is configured to be secured about the at least one wall of both the first and second pallet members after the transportable unit is positioned on both the first and second pallet member support surfaces such that a unified structure for transport is formed.

13 Claims, 9 Drawing Sheets

TWO-PIECE VIBRATION DAMPENING PALLET ASSEMBLY

This application claims the benefit of U.S. Provisional Application No. 62/927,565, filed on Oct. 29, 2019, the contents of which are incorporated herein by reference.

FIELD

This disclosure relates to transportation pallets. More particularly, the disclosure relates to a two-piece vibration dampening pallet assembly.

BACKGROUND

Various large, fragile items are shipped between manufacturers and costumers and often change hands several times during transportation. One example of such an item is a vanity including a cabinet and a countertop. Under current shipping practices, a large number of the vanities arrive with the countertop broken. In addition to an unhappy customer, the vanity needs to be shipped back and replaced.

Under current shipping practices, the vanities are typically packed in corrugated boxes with foam polystyrene packaging materials. The packages oftent arrive via ship/container from Asia and most are intact. The packages may then be put on a pallet and enclosed within another five-sided corrugated box over the existing packaging. The five-sided box is to allow for double stacking of units in the transport truck. It has been found that vibration, and to a lesser degree shock, in transit is causing a significant amount of breakage.

Another difficulty in shipping these large, fragile items is the variations in size. Again, looking at vanities as an example, it is often necessary to have mulitple pallet sizes to accommodate the various size vanities. Even if each size pallet is used for multiple size vanities, there is still a need for multiple pallets because vanity lengths vary so drastically.

SUMMARY

In at least one embodiment, the present disclosure provides a pallet assembly for transporting a transportable unit. The pallet assembly includes a first pallet member including a support surface with at least one wall extending upwardly therefrom and a second pallet member including a support surface with at least one wall extending therefrom. A band is configured to be secured about the at least one wall of both the first and second pallet members after the transportable unit is positioned on both the first and second pallet member support surfaces such that a unified structure for transport is formed.

In at least one embodiment, a pair of feet extend downwardly from each of the support surfaces to a free end. In at least one embodiment, a respective dampener extends from the free end of each of the feet.

In at least one embodiment, the present disclosure provides a method of packaging and unpackaging a transportable unit having opposed first and second ends, the method includes: positioning the first end of the transportable unit on a first support surface of a first pallet member such that the transportable unit abuts a first end wall extending upwardly from the first support surface, the first pallet member having a pair of first feet depending from the first support surface proximate the first end wall; positioning the second end of the transportable unit on a second support surface of a second pallet member such that the transportable unit abuts a second end wall extending upwardly from the second support surface, the first pallet member having a pair of first feet depending from the first support surface proximate the first end wall; and securing a band about the first and second end walls of the first and second pallet members such that a unified structure for transport is formed.

In at least one embodiment, the method further includes removing the band; pushing the transportable unit toward the second pallet member such that the first end of the transportable unit slides down the first support surface of the first pallet member, the first pallet member pivoting about the feet thereof as the transportable unit slides there down; pushing the transportable unit toward the second pallet member until the transportable unit is clear of the first pallet member; pushing the transportable unit away from the second pallet member such that the second end of the transportable unit slides down the second support surface of the second pallet member, the second pallet member pivoting about the feet thereof as the transportable unit slides there down; and pushing the transportable unit away from the second pallet member until the transportable unit is clear of the second pallet member.

BRIEF DESCRIPTION OF THE DRAWINGS

The accompanying drawings, which are incorporated herein and constitute part of this specification, illustrate the presently preferred embodiments of the disclosure, and, together with the general description given above and the detailed description given below, serve to explain the features of the disclosure. In the drawings.

DETAILED DESCRIPTION

Figure 1:
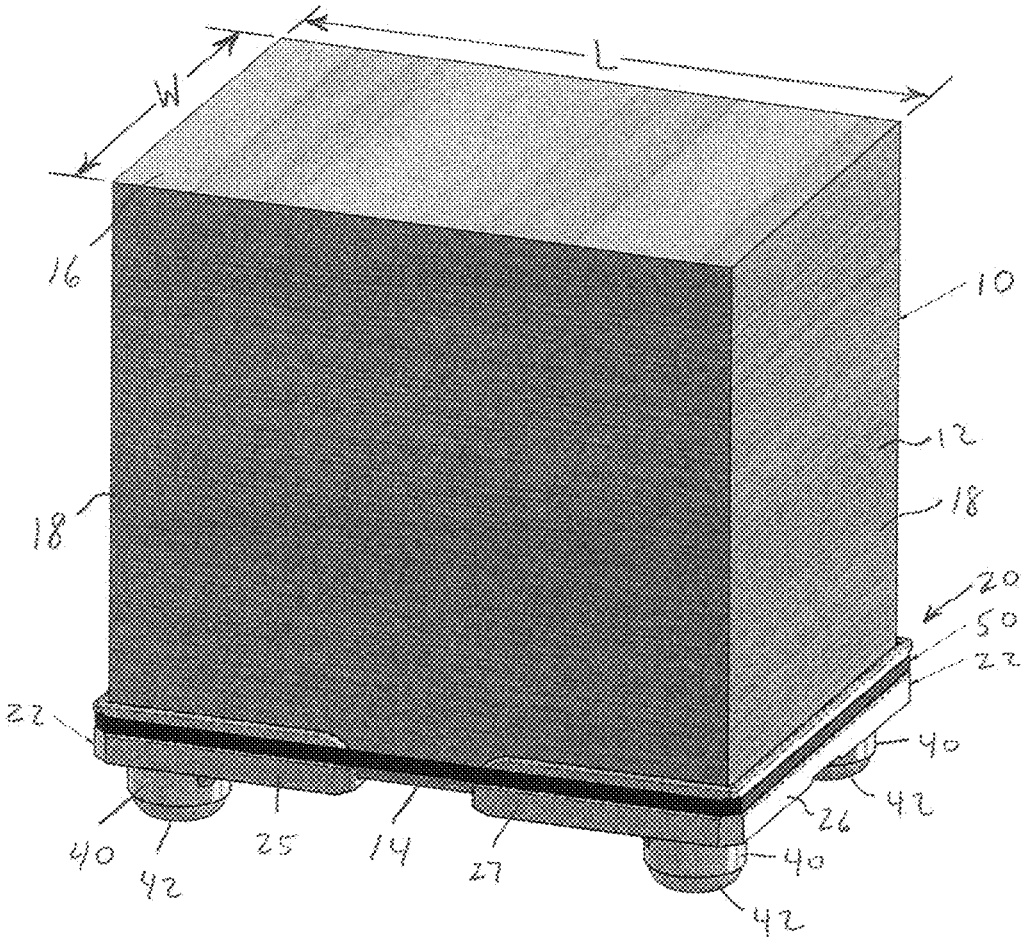
FIG. 1 is a perspective view of a two-piece pallet assembly in accordance with an embodiment of the disclosure supporting a transportable unit therein.

In the drawings, like numerals indicate like elements throughout. Certain terminology is used herein for convenience only and is not to be taken as a limitation on the present disclosure. The following describes preferred embodiments of the present disclosure. However, it should be understood, based on this disclosure, that the disclosure is not limited by the preferred embodiments described herein.

Figure 2:
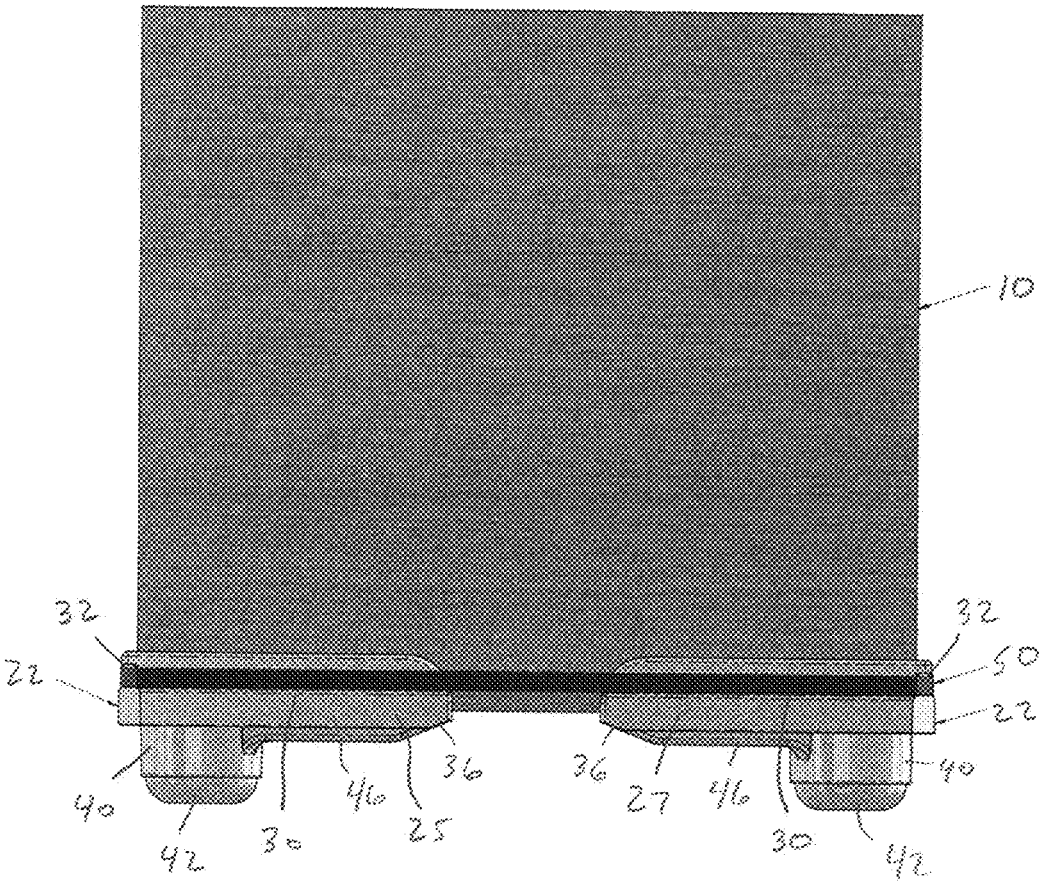
FIG. 2 is a front elevation view of the two-piece pallet assembly of FIG. 1 supporting a transportable unit therein.
Figure 3:
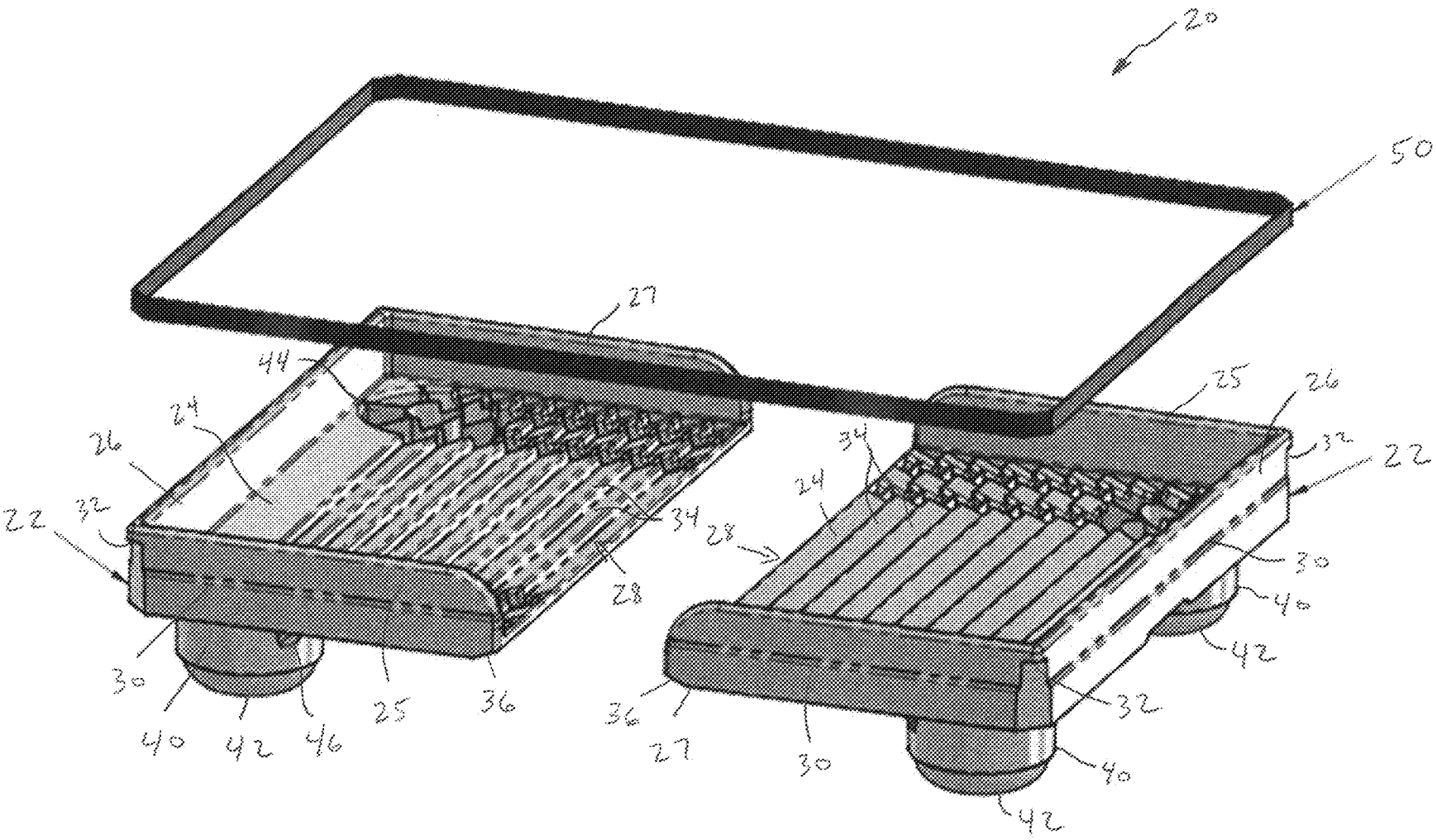
FIG. 3 is an exploded perspective view of the two-piece pallet assembly of FIG. 1.

Referring to FIGS. 1-3, a two-piece pallet assembly 20 in accordance with an embodiment of the disclosure will be described. The pallet assembly 20 is configured to support transportable units 10, for example, a cabinet, vanity or the like, for transport. The transportable unit 10 has a body 12 extending between a lower surface 14 and an upper surface 16 and between opposed ends 18. The transportable unit 10 may be in the form of a box positioned about a cabinet, vanity or the like or may be the actual cabinet, vanity or the like. The transportation unit 10 has a width W and a length L. The pallet assembly 20 illustrated in FIGS. 1-3 is configured to support various units having a common width but of various lengths. It is understood that the pallet assembly 20 may be configured to support units of varying widths as will be described in more detail hereinafter.

The two-piece pallet assembly 20 includes a pair of pallet members 22 and a securing band or strap 50. In the illustrated embodiment, each of the pallet members 22 have the same configuration, however, it is understood that the pallet members 22 could have differing configurations, for example, if the transportable unit 10 has different configurations at each of its ends 18. Each of the pallet members 22 is configured to be secured along the lower surface 14 of the transportable unit 10 at a respective end 18. As shown in FIGS. 1 and 2, with the pallet members 22 so positioned at each end, the band 50 is secured about both pallet members 22 to form a unified structure which supports the transportable unit 10. As will be described in more detail hereinafter, each of the pallet members 22 includes depending feet 40 such that the transportable unit 10 is supported in an elevated position. This allows the unified structure to be moved utilizing manual or electric pallet jacks or with a forklift.

Referring to FIG. 3, each pallet member 22 includes a generally planar support surface 24 which is enclosed three sides by opposed side walls 25, 27 and an end wall 26. The remaining side is generally open as indicated at 28 such that the transportable unit 10 may extend from the support surface 24. In the illustrated embodiment, the support surface 24 has a plurality of steps 34 formed therein which may be utilized to gradually lower the transportable unit 10 during unloading as will be described hereinafter. It is understood that the support surface 24 may have other configurations, including a flat surface or sloped, depending on the application. Additionally, the outer surface of the support surface 24 adjacent the open end 28 may be formed with a sloped portion 36 to assist in unloading as will be described below.

In the illustrated embodiment, the support surface 24 has a width between the side walls 25, 27 which is equal to or slightly larger than the width W of the transportable unit 10 and a length from the end wall 26 to the open end 28 which is equal to or smaller than one-half the length L of the transportable unit 10. With this configuration, each end 18 of the transportable unit 10 may be securely received and supported on a respective support surface 24. Because the transportable unit 10 extends from the open end 28 of each pallet member 22, the pair of pallet members 22 may be utilized with transportable units 10 of varying lengths. Once the transportable unit 10 is positioned on the pair of pallet members 22, the band 50 is tightly secured about the two pallet members 22 to form the unified structure.

To retain the band 50 in place, a groove or the like may be formed along the side walls 25, 27 and/or end walls 26. In the illustrated embodiment, the upper portion of each of the side walls 25, 27 and end walls 26 is inward of the lower portion thereof such that a lower ridge 30 is defined along each wall 25-27. Additionally, an overhang 32 is formed at the upper edge of each closed corner of each pallet member 22. As such, the band 50 is held in position between the lower ridge 30 and the overhangs 32. The bands 50 may be made from metal, nylon or any other desired material. Various mechanisms, for example, buckles, clasps, staples, welds fusion or the like, may be utilized to secured the ends of the band 50 once it is tightened about the pallet members 22.

While the illustrated embodiment of the pallet assembly 20 is configured for use with transportable units 10 of a given width, it is recognized that the pallet members 22 may be configured such that they may be utilized for units 10 of varying widths. For example, as a first alternative, each pallet member 22 may be formed without the sidewalls 25, 27 such that wider transportable units would overhang the sides of the support platform 24, yet the band 50 would still engage the end walls 26 to form the unified structure. As yet another alternative, one or both side walls 25, 27 may be supported relative to the support surface 24 in a telescoping manner. That is, for wider transportable units 10, one or both side walls 25, 27 may be adjusted outwardly from the support platform 24 while still supported thereby. In yet another alternative embodiment, the support platform 24 may be formed by two pieces which are telescopingly interconnected to one another such that the width of the support platform 24 may be adjusted.

Referring again to FIGS. 1-3, each pallet member 22 has a pair of feet 40 depending from the support surface 24 proximate the closed end thereof. The positioning of the feet 40 proximate the closed end allows the pallet members 22 to provide wide support of the transportable member 10 when in the unified structure, transport configuration illustrated in FIGS. 1 and 2, but allows each pallet member 22 to pivot to an unloading position (see FIGS. 7 and 10) during unloading as will be described hereinafter. In the illustrated embodiment, each of the feet 40 is formed as a hollow structure with internal ribs 44 to minimize weight, however, other structures may be utilized. Additionally, external ribbing 46 maybe provided, for example, between the feet 40 and the support surface 24 for additional rigidity and/or strength.

A dampener 42 is positioned at the free end of each of the feet 40 and extends therefrom such that dampeners 42 will sit on the surface upon which the pallet assembly 20 is positioned. The dampeners 42 are elastomeric such that they absorb vibration and shock which may be transmitted to the pallet assembly 20. The illustrated dampeners 42 have a solid structure, for example, made of rubber or an elastomeric foam structure. The dampeners 42 may have other configurations, for example, an elastomeric sack filled with air or other fluids, for example, liquids or gels. Additionally, the dampener may be sealed with a fixed amount of fluid or may be fillable to include any desired amount of fluid.

Figure 4:
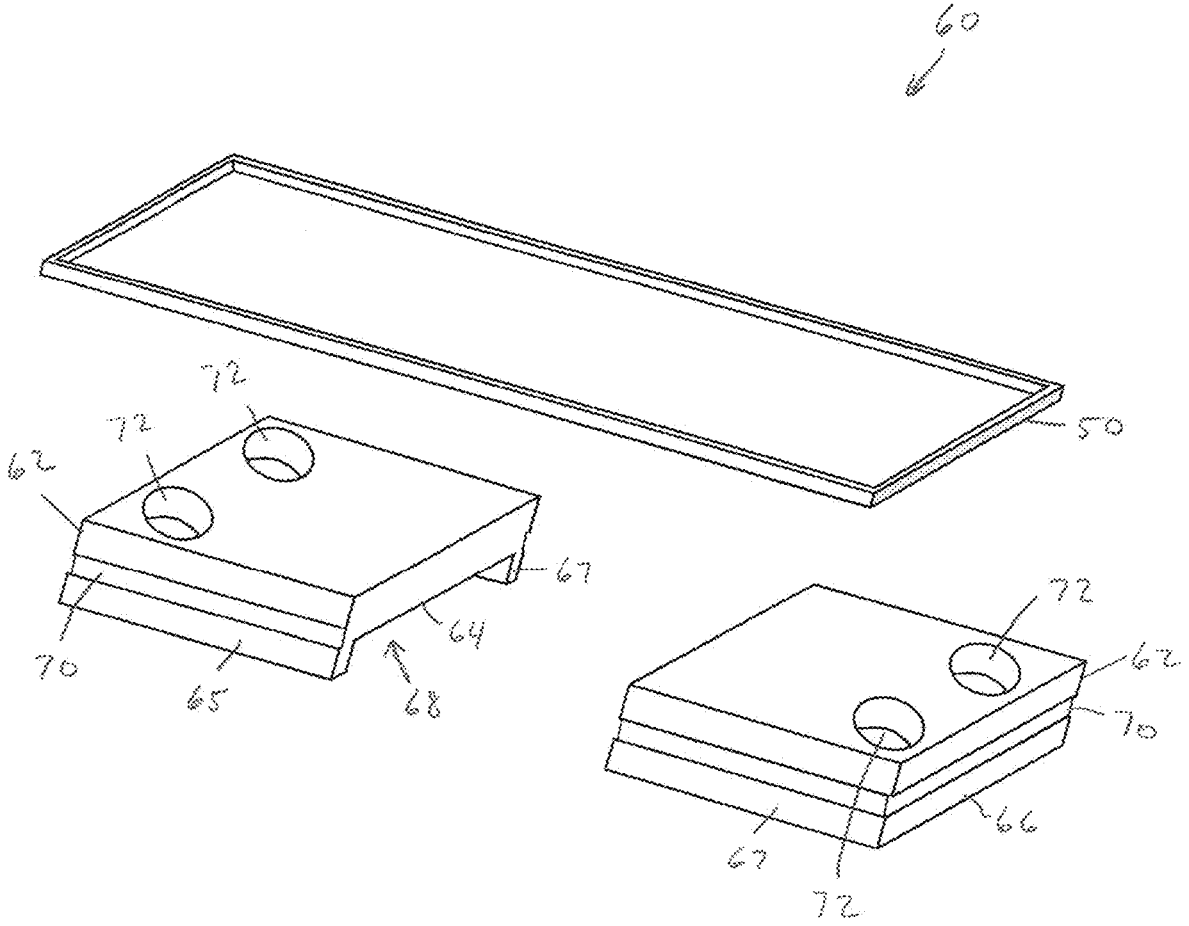
FIG. 4 is an exploded perspective view of an optional top pallet assembly in accordance with an embodiment of the disclosure.

Turning to FIG. 4, an optional top pallet assembly 60 in accordance with an embodiment of the disclosure will be described. The top pallet assembly 60 may be utilized if it is desired to stack transportable units 10 on top of one another during transport. The top pallet assembly 60 includes a pair of pallet members 62 and a band 50. The pallet members 62 are similar to the pallet members 22 but are configured to be positioned on the top surface 16 of a transportable unit 10 and, instead of feet, the pallet members 62 include feet receiving openings 72 configured to receive the feet 40 of a pallet assembly 20 stacked thereon. More specifically, each pallet member 62 has a support surface 64 with depending side walls 65, 67 and an end wall 66. The end opposite the end wall 66 defines an open end 68 such that the pallet members 62 may be positioned along the top surface 16 at respective ends 18 of the transportable unit 10. A groove 70 or the like may be defined along the walls 65-67 to receive and retain the band 50. The upper surface of each support platform 64 defines a pair of receiving holes 72 sized and positioned to receive the respective feet 40 of a pallet assembly 20 stacked on top of the top pallet assembly 60. Such optional top pallet assembly 60 allows the units 10 to be stacked without the need for an additional five-sided box.

Having generally described the components of the pallet assembly 20, an illustrative method of unloading a transportable unit 10 from the pallet assembly 20 will be described with reference to FIGS. 5-11. After the unit 10 has been transported securely within the pallet assembly 20, as shown in FIGS. 1 and 2, it is delivered to the customer where it is ready to be unloaded. The configuration of the pallet assembly 20 allows the unit 10 to be safely unloaded by the end user without the need for any equipment.

Figure 5:
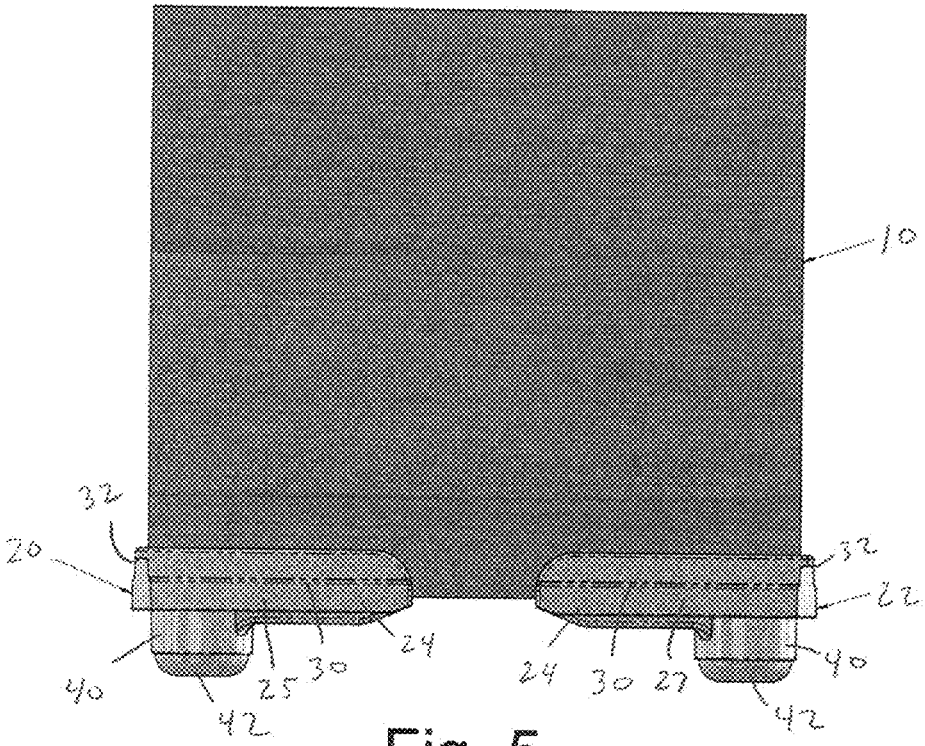
FIGS. 5-11 are side elevation views illustrating the sequential unloading of the transportation unit from the two-piece pallet assembly in accordance with an embodiment of the disclosure.

Referring to FIG. 5, the first unloading step is to remove the band. With the feet 40 positioned toward the closed ends of the pallet members 22, the transportable unit 10 remains supported in a balanced position.

Figure 6:
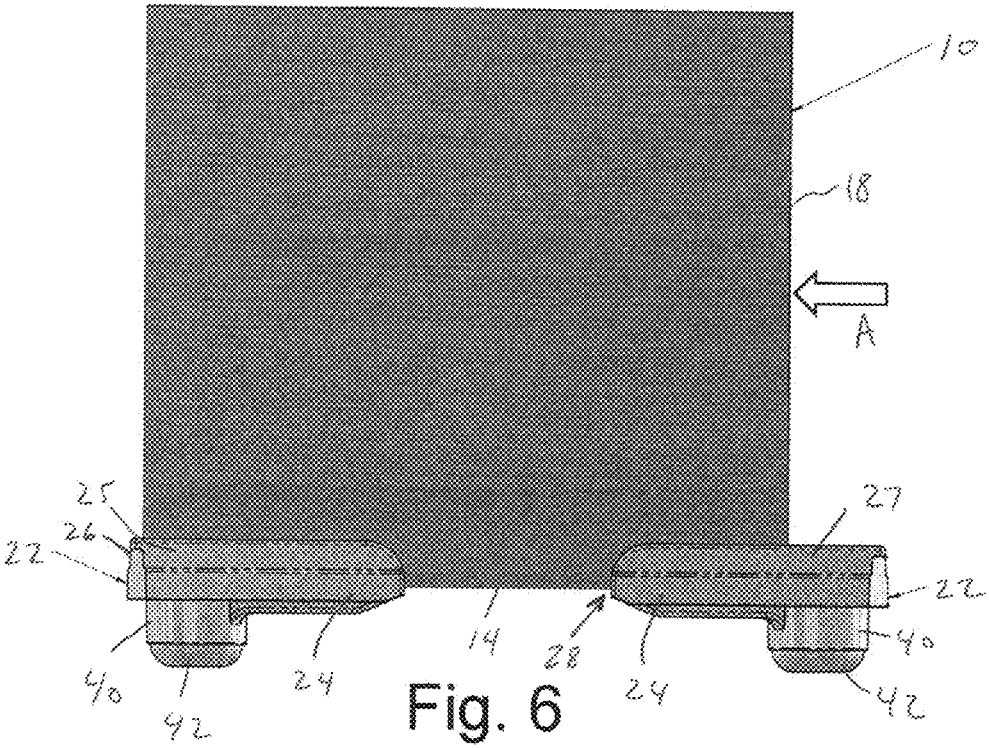

Next, the transportable unit 10 is pushed from one of the ends 18 towards the other end as indicated by arrow A in FIG. 6. The unit 10 will slide along the support surface 24 of the near pallet member 22 while contacting the rear wall 26 and thereby pushing the opposite pallet member 22.

Figure 7:
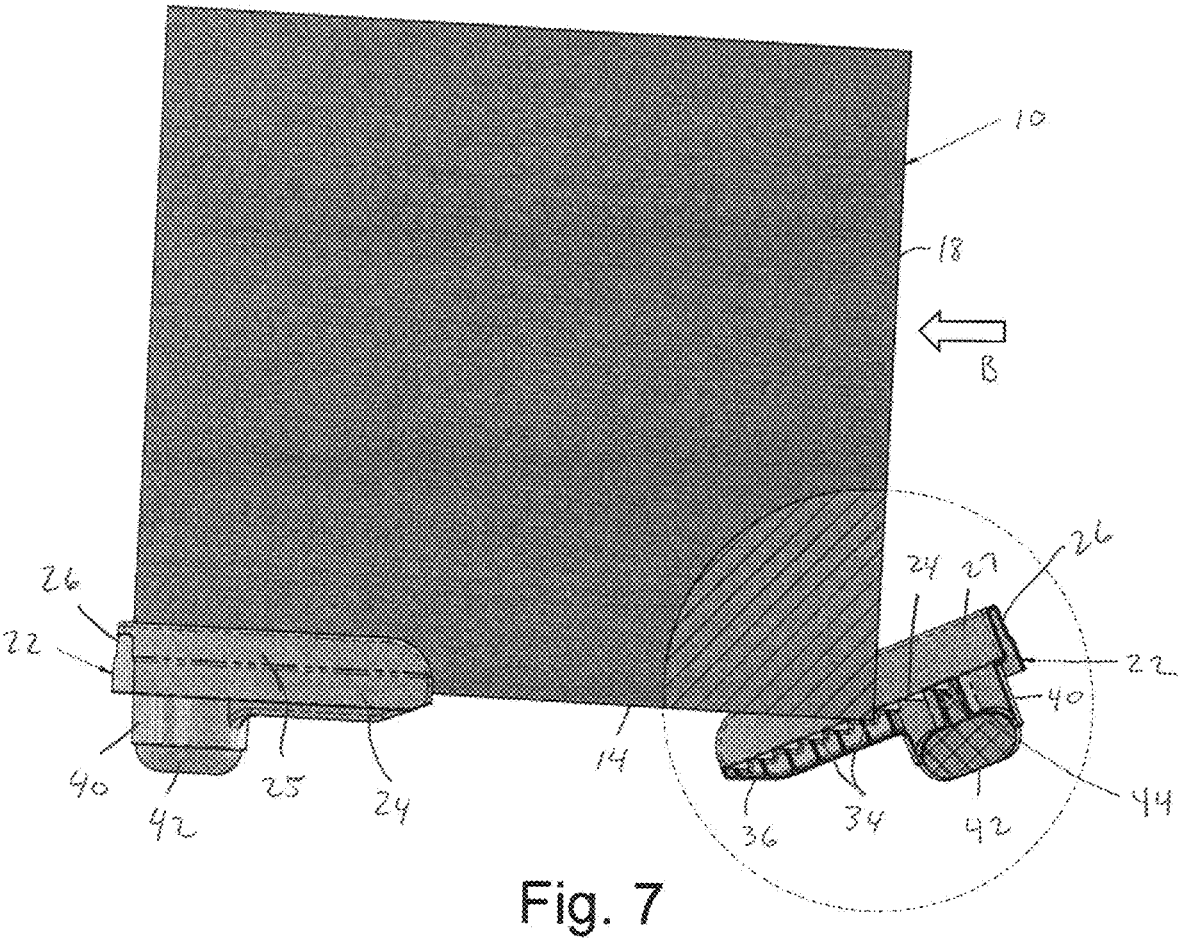
Figure 8:
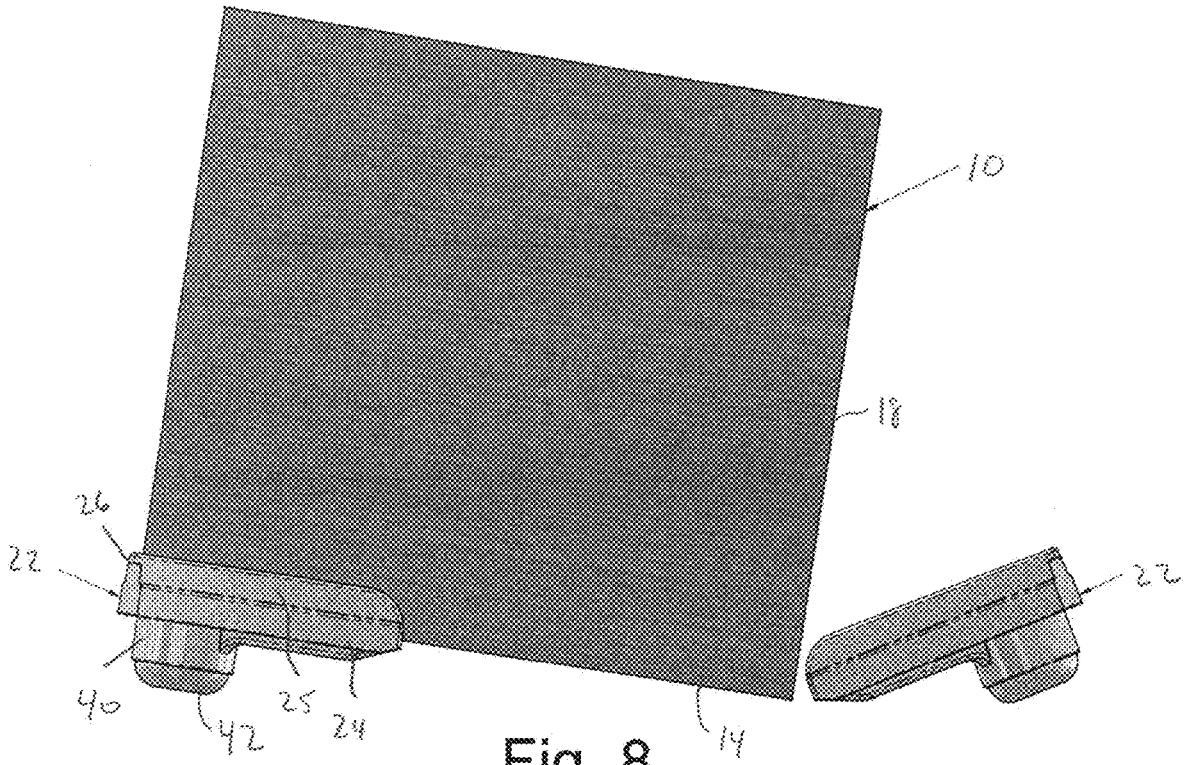

As the transportable unit 10 is continued to be pushed as indicated by arrow B in FIG. 7, the weight of the transportable unit 10 will no longer be above the feet 40 of the near pallet member 22 and the near pallet member 22 will begin to pivot relative to the feet 40. As the pallet member 22 pivots downward, the support surface 24 forms a ramp for the unit 10 to slide on. The steps 34 on the support surface 24 allow for a controlled removal or unloading of heavy units 10 from the pallet member 22. The transportable unit 10 is continued to be moved along the support surface 24 until the lower surface 14 at that end 18 of the unit 10 is on the ground as shown in FIG. 8. The removed pallet member 22 is moved out of the way.

Figure 9:
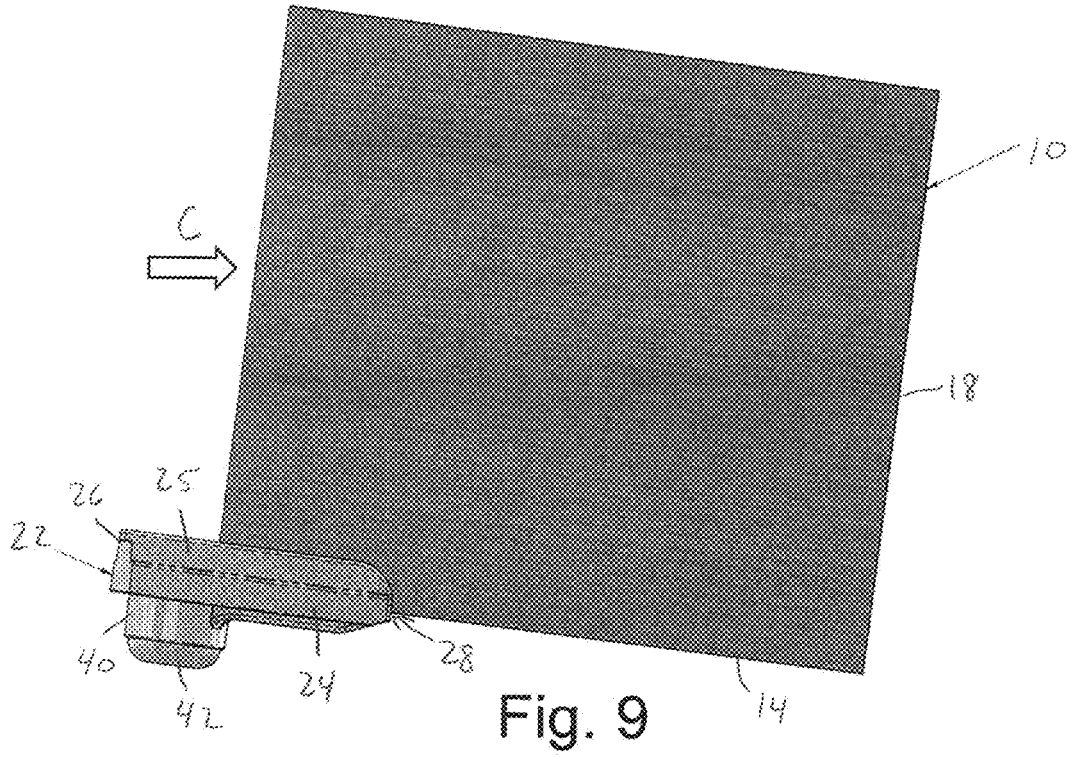

Turning to FIG. 9, the opposite end 18 of the transportable unit 10 is pushed in the opposite direction as indicated by arrow C. The unit 10 will slide along the support surface 24 of the remaining pallet member 22.

Figure 10:
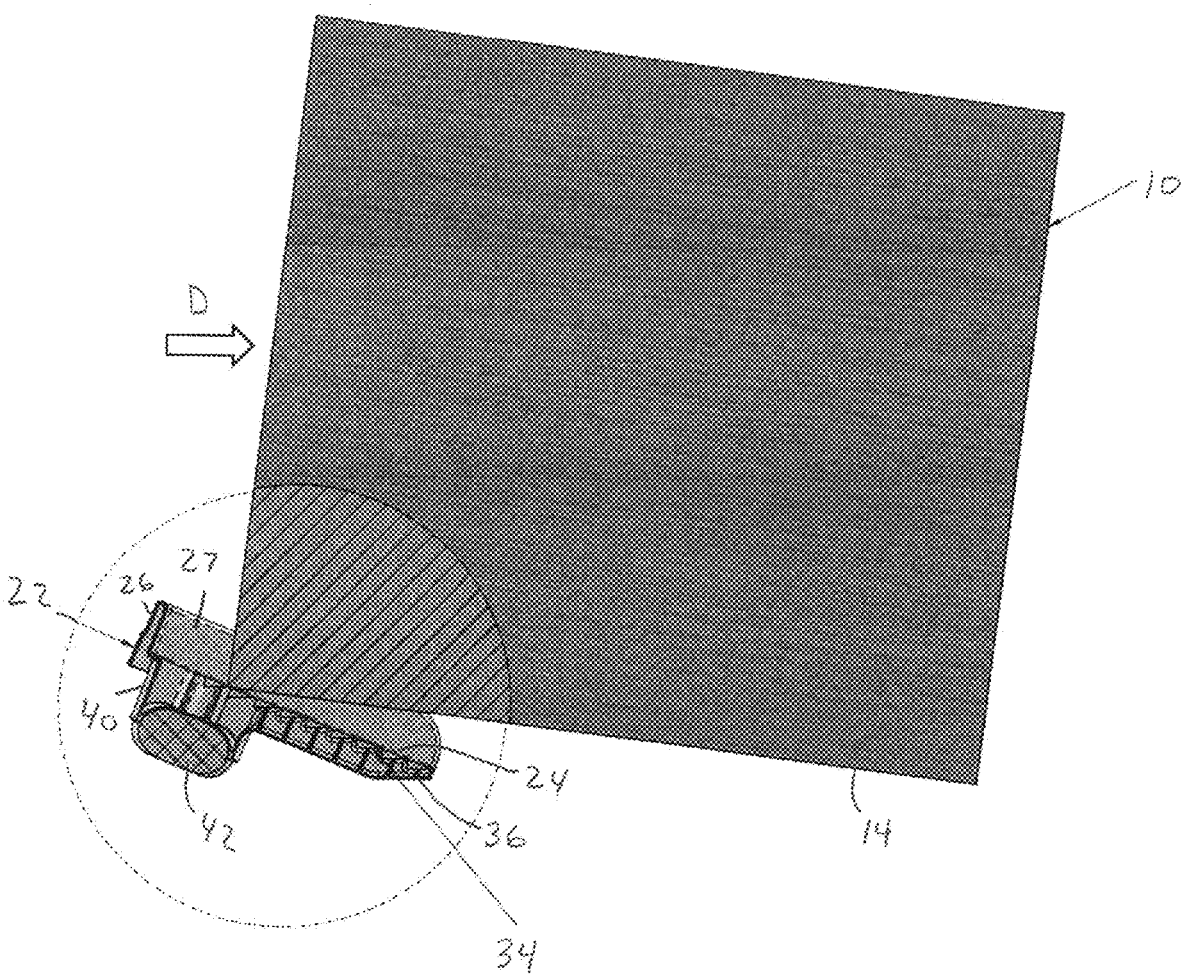
Figure 11:
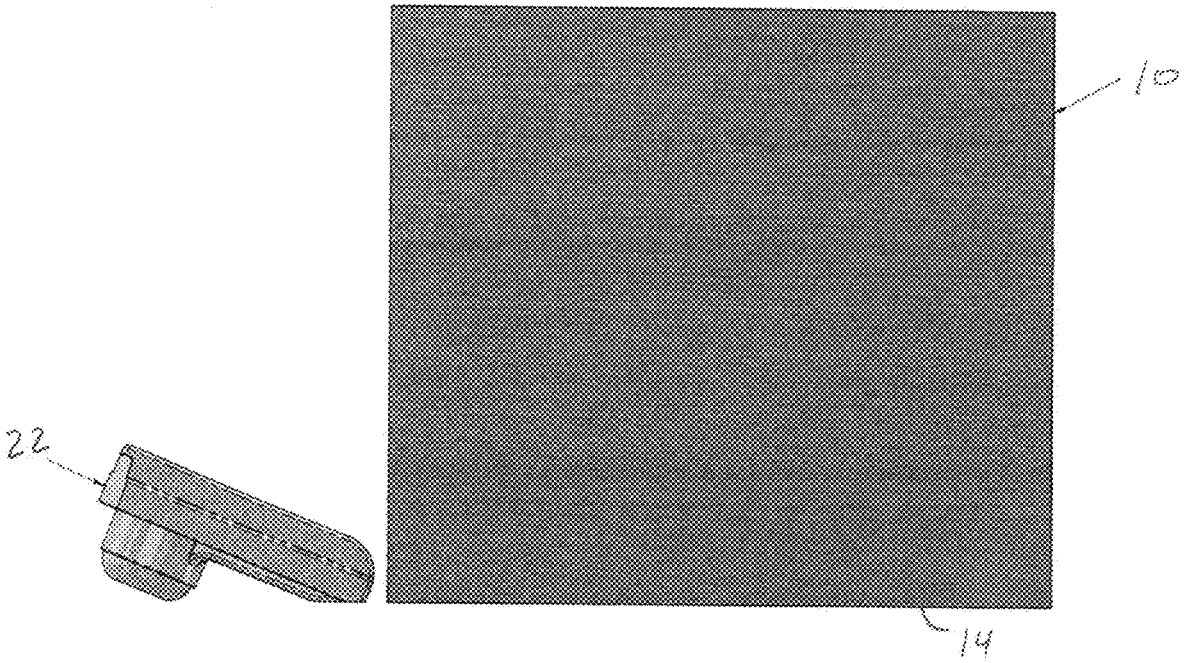

As the transportable unit 10 is continued to be pushed as indicated by arrow Din FIG. 10, the weight of the transportable unit 10 will no longer be above the feet 40 of the remaining pallet member 22 and the pallet member 22 will begin to pivot relative to the feet 40. As the pallet member 22 pivots downward, the support surface 24 forms a ramp for the unit 10 to slide on. The steps 34 on the support surface 24 again allow for a controlled removal or unloading of heavy units 10 from the pallet member 22. The transportable unit 10 is continued to be moved along the support surface 24 until the lower surface 14 at that end 18 of the unit 10 is on the ground as shown in FIG. 11.

Once the transportable unit 10 has been unloaded, the pallet assembly 20 may be returned for reuse. In addition to providing secure, vibration resistant transport and easy unloading, the pallet assembly 20 may provide additional benefits over the currently used methods of transport. For example, the pallet assembly 20 is much smaller than a standard pallet, allowing for more compact storage and lower return shipping costs. Additionally, the pallet assembly 20 will be lighter than standard pallets, lowering the transport weight and associated freight costs. Additionally, the dampeners 42 will last longer than the additional foam being utilized in current practices and will not require any further labor to install as compared to the foam. As yet another potential benefit, the pallet assembly 20 will have specific uses and therefore will be less desirable for theft, resulting in a lower loss percentage. Additionally, the pallet assembly 20 will cost less than a standard pallet, providing an initial savings and also, if an assembly is lost, the financial impact is less.

These and other advantages of the present disclosure will be apparent to those skilled in the art from the foregoing specification. Accordingly, it will be recognized by those skilled in the art that changes or modifications may be made to the above-described embodiments without departing from the broad inventive concepts of the disclosure. It should therefore be understood that this disclosure is not limited to the particular embodiments described herein, but is intended to include all changes and modifications that are within the scope and spirit of the disclosure as defined in the claims.

What is claimed is:

1. A pallet assembly for transporting a transportable unit, the pallet assembly comprising: a first pallet member including a support surface with at least one wall extending upwardly therefrom;

a second pallet member including a support surface with at least one wall extendingupwardly therefrom;

a first top pallet member including a support surface with at least one wall extending downwardly therefrom;

a second top pallet member including a support surface with at least one wall extending downwardly therefrom; and at least one band configured to be secured about one or both of: (i) the at least one wall of both the first and secondpallet members and (ii) the at least one wall of both the first and second top pallet members after the transportable unit is positioned on both the first and second pallet member support surfaces such that a unified structure for transport is formed.

2. The pallet assembly according to claim 1 wherein a pair of feet extend downwardly fromeach of the support surfaces to a free end.

3. The pallet assembly according to claim 2 wherein a respective dampener extends fromthe free end of each of the feet.

4. The pallet assembly according to claim 3 wherein each dampener has an elastomericstructure.

5. The pallet assembly according to claim 2 wherein the at least one wall of each pallet member defines a substantially closed end and an open end of the respective support surface andthe pair of feet are positioned proximate the substantially closed end.

6. The pallet assembly according to claim 1 wherein the at least one wall of each pallet member defines an end wall along a first edge of the respective support surface and a pair of opposed side walls along second and third edges of the respective support surface with a fourthedge of the support surface defining an open edge.

7. The pallet assembly of claim 6 wherein a distance between the side walls is equal to orslightly greater than a width of the transportable unit.

8. The pallet assembly of claim 6 wherein a distance between the side walls is adjustable.

9. The pallet assembly of claim 6 wherein a distance between the end wall and the openedge is less than or equal to one-half of a length of the transportable unit.

10. The pallet assembly of claim 1 wherein the support surface of each pallet member has astepped configuration.

11. The pallet assembly of claim 1 wherein each support surface defines at least a first openedge and wherein the each pallet member has a tapered outer surface along the first open edge.

12. The pallet assembly of claim 1 wherein the at least one wall of each pallet memberdefines a strap retaining groove.

13. The pallet assembly of claim 1 wherein each of the top pallet members includes an upper surface opposite its support surface and wherein each upper surface defines a pair of feet receiving openings.

* * * * *